US006976858B1

(12) United States Patent
Kikuchi et al.

(10) Patent No.: US 6,976,858 B1
(45) Date of Patent: Dec. 20, 2005

(54) ELECTRIC CONNECTOR

(75) Inventors: Hitoshi Kikuchi, Tokyo (JP); Hiromichi Kato, Tokyo (JP); Masato Hida, Tokyo (JP); Hirokazu Takahashi, Tokyo (JP); Kazunori Takei, Tokyo (JP)

(73) Assignee: DDK Ltd., (JP)

( * ) Notice: Subject to any disclaimer, the term of this patent is extended or adjusted under 35 U.S.C. 154(b) by 0 days.

(21) Appl. No.: 10/853,822

(22) Filed: May 26, 2004

(51) Int. Cl.[7] ..... H01R 13/44
(52) U.S. Cl. ..... 439/140; 439/752
(58) Field of Search ..... 439/140, 141, 439/752, 892

(56) References Cited

U.S. PATENT DOCUMENTS 5,035,633 A * 7/1991 Kobayashi et al. ..... 439/140
5,167,516 A * 12/1992 Tan et al. ..... 439/141
5,755,600 A * 5/1998 Yoshida ..... 439/752
5,997,342 A * 12/1999 Suzuki ..... 439/489
6,102,715 A * 8/2000 Centofante ..... 439/140
6,422,881 B1 * 7/2002 Puhl et al. ..... 439/140
6,846,191 B2 * 1/2005 Hobbs et al. ..... 439/157

* cited by examiner

*Primary Examiner*—P. Austin Bradley
*Assistant Examiner*—X. Chung-Trans
(74) *Attorney, Agent, or Firm*—Baker Botts L.L.P.

(57) ABSTRACT

An electric connector provided with a protector to protect damage of top of contacts by an outer force or misinsertion of mating connector or card and with construction easy for assembling. The connector body is provided with an insertion opening in a direction normal to the mating connector or card insertion direction and the protector is inserted through the insertion opening at the time of assembling and the protector is kept its normal position by the bias spring.

5 Claims, 6 Drawing Sheets

ELECTRIC CONNECTOR

BACKGROUND OF THE INVENTION

1. Field of the Invention

The present invention relates to an electric connector. More especially the invention relates to an electric connector intended to protect the top portion of the male contacts arranged in a male connector and those being assembled in an easy manner.

2. Prior Art

In this technical filed, two prior arts belonging to the same assignee of this invention had been opened before public recently.

The first one is Japanese Patent Application Opened No. 10-41019 opened on Feb. 10, 1998. FIG. 5 shows the idea of this first prior art. In order to help the understanding of this invention, this prior art will be explained briefly at first.

This electric connector shown in FIG. 5 consists of a male connector 110 and a female connector 120. The male connector 110 having male contacts 112 adapted to be connected with female contacts 123. In order to protect the top portions of the male contacts 112, there are provided with a plate-shaped locator or protector 115 made of an insulating material formed with contact apertures 115*a* through which the male contacts 112 extend so that the plate-shaped locator 115 is slidably movable against the upwardly surging force of spring 116 provided at both ends. The top portions of the male contacts 112 are effectively protected from external impulsive force or contacting force by the plate-shaped locator 115. Whereas when the female connector 120 is to be coupled to the male connector 110, the locator or protector 115 is pressed down against the spring force of springs 116 by the bottom edge of the female connector 120 and the contacts are coupled correctly.

The second one of the prior arts is Japanese Patent Application opened No. 2004-31224.

The idea of this prior art is as shown in FIG. 6 and FIG. 7. The principle of this second prior art is almost the same as that of the first prior art. But this prior art is mainly intended to prevent damage of the top portions of the male contacts by mis-insertion of fitting card to be mated with the male contact.

Namely, this type of connector is used to accommodate a memory card inserted thereto with its longer edge. Whereas the general user is used to use a card with its shorter edge to insert into a machine, like a telephone card etc. In such a case the top portion of the male contacts is damaged by the misinsertion of the card.

In order to prevent damage of the male contacts 212, a protector 215 is provided as shown in FIG. 7. This protector 215 is restricted its backward movement by an engagement with a hook 220 at the back portion. The protector 215 is pressed forwardly by springs 216 to keep the protecting position as shown in FIG. 7. Only at correct direction insertion of the mating card the engaging spring 220 is depressed downwardly and disengage the restriction of movement of the protector 215.

In other case, the engaging spring 220 is not depressed and the plate shape protector 215 is kept at protecting position by the spring 216.

The inventors had noticed that in these prior arts, at the time of assembling the locator or the protector and the bias spring and other parts are arranged from the open end of the male connector 110 or 210 and its work was somewhat troublesome.

SUMMARY OF THE INVENTION

The present invention has for its object to offer a new design of connector having the protector and very easy for assembling.

The present invention is to realize a male connector of the aforementioned type and having the protector with very easy for assembling.

In accordance with the present invention, the connector having main body provided with an insertion hole of the protector. The insertion hole is extending in lateral direction with respect to the insertion direction of the card. When assembling the connector, the protector is inserted into the body through the insertion hole being provided in lateral direction with normal insertion direction of the mating card.

DESCRIPTION OF THE PREFERRED EMBODIMENT

Figure 1:
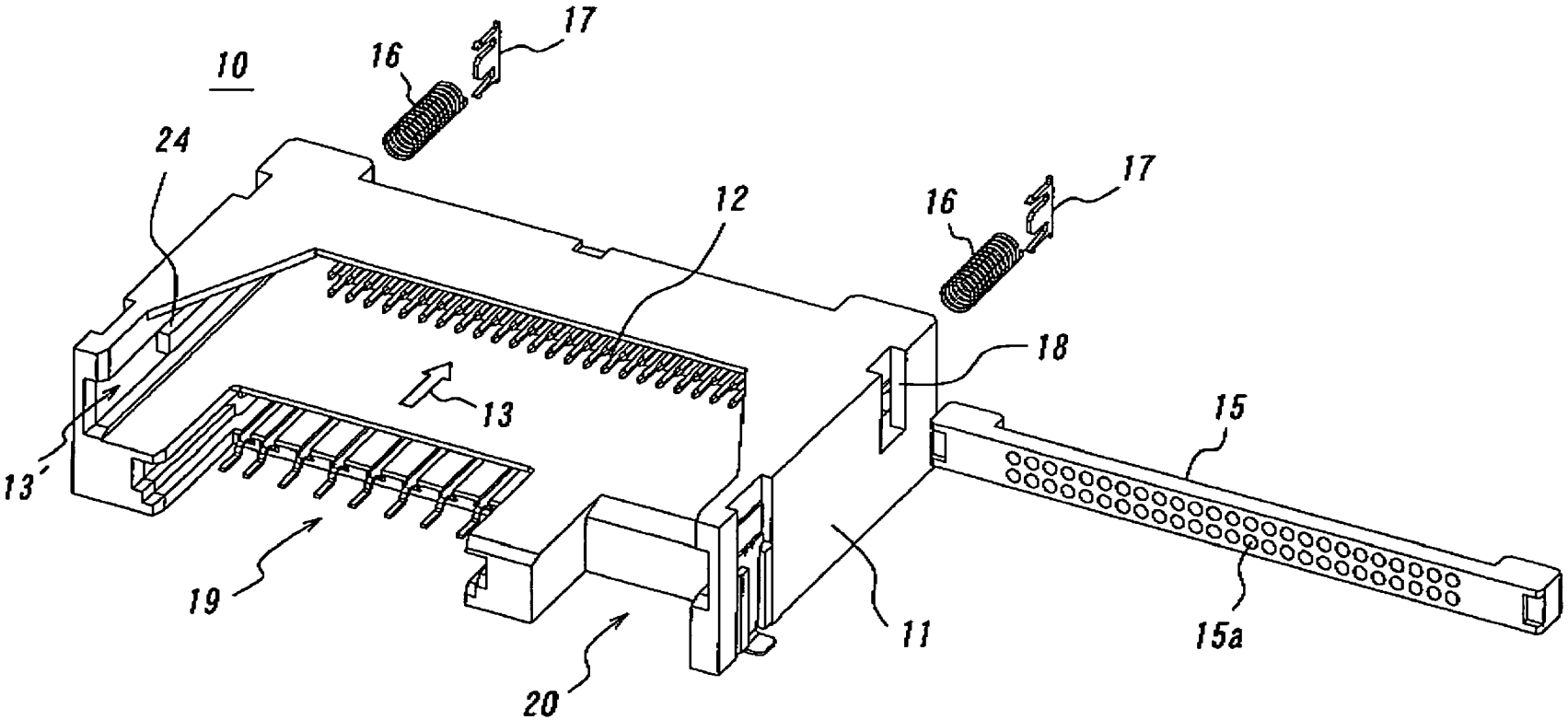
FIG. 1 showing in perspective view of the connector in a state before inserting the protector.

The invention will be explained by referring to the drawings showing one embodiment of the invention and some prior arts.

FIG. 1 shows in a perspective view of one embodiment of a connector 10 having 50 pin contacts before assembling the protector. These pins are male contacts to be connected to female contacts in the mating card (not shown).

The connector 10 having a connector body 11 made of plastics. Reference numeral 12 shows the pin contacts arranged in two rows each having 25 pins.

A space 13 shown by a big arrow mark is a space where the mating card is to be inserted. There are two guide slits 13' and 13' provided at both ends of the space 13 to guide to insert the mating card. Two more spaces 19 and 20 shown below the space 13 are coupling hole for the electric source and others. But these spaces are not related to the invention and detailed explanation is omitted.

In the present invention, the protector 15 having through holes 15*a* with the corresponding number of the contact pins 12 is used to protect the top of pins 12. Each of the through holes 15*a* allows to pass the respective pin contacts 12.

FIG. 1 shows grammatically a condition before assembling the connector with the protector 15. The protector 15 is inserted into the connector body 11 through an insertion opening 18 provided at both sides of the connector body 11.

Figure 3:
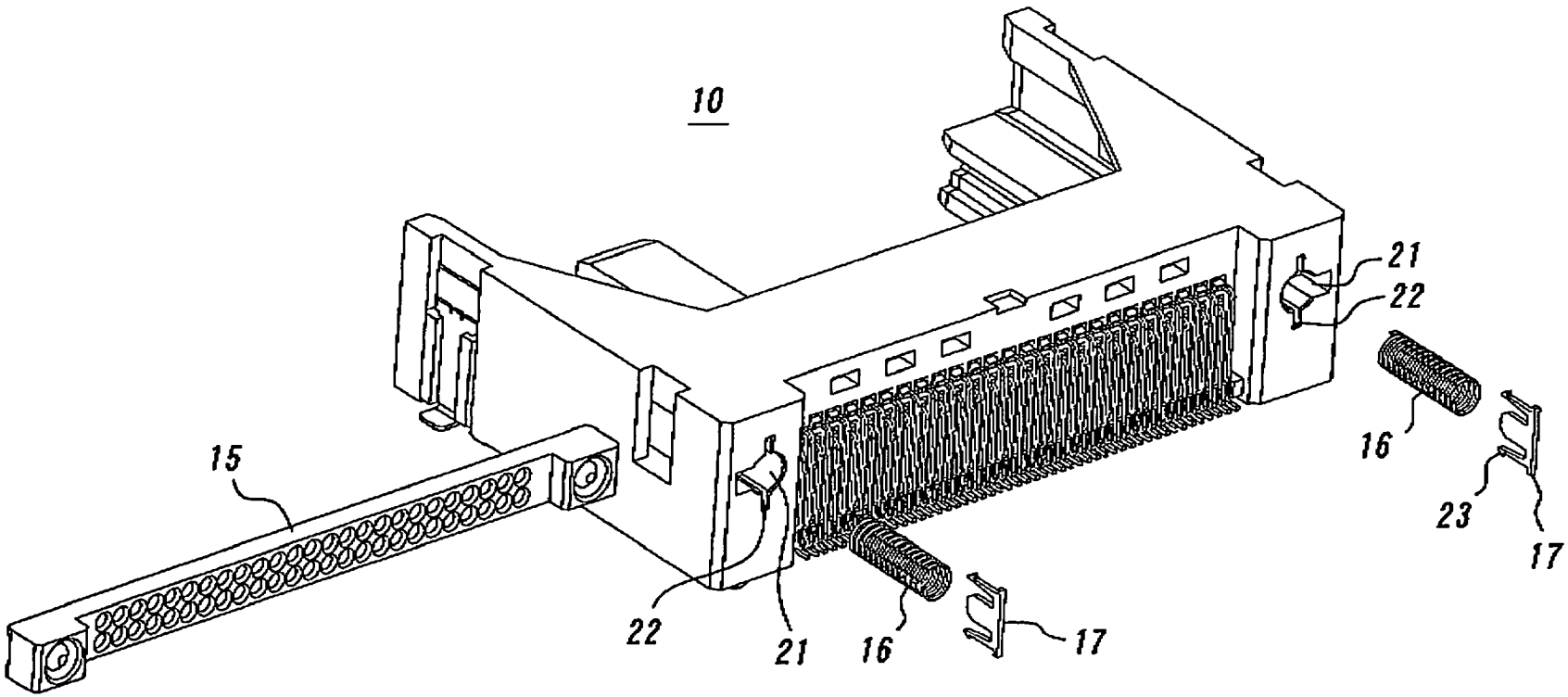
FIG. 3 and FIG. 4 are back views of FIG. 1 and FIG. 2, respectively.

When the protector 15 is inserted into the connector body 11, it can be fixed by inserting two bias springs 16, which is fixed in position by stop keys 17 as better shown in FIG. 3. These keys 17 are inserted into slits 22 of the coil spring insertion opening 21. The keys 17 are kept in position by hooks 23 at two spring ends.

Figure 2:
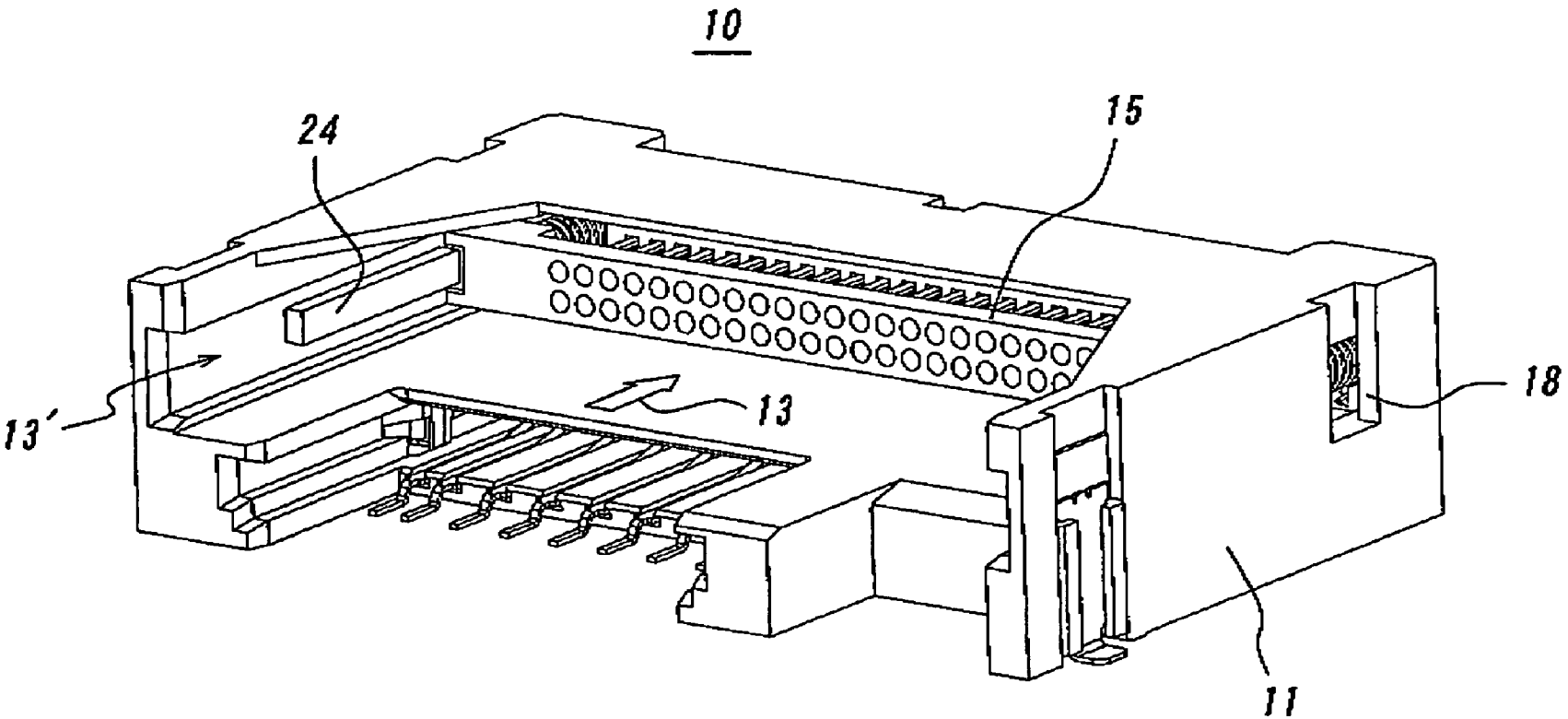
FIG. 2 shows a perspective view of the connector after assembling the protector.

At this position the protector 15 is restricted from its forward movement by an end surface of the guide rails 24 shown in FIG. 2. But the protector 15 can be pressed backwardly against the bias force of springs 16 when the mating card is inserted along the guide slots 13' at both sides.

By depressing the protector 15 backwardly, the mating card may have its female contacts connected to the pin shaped male contacts 12 extending through the through holes 15*a* and a correct connection is established.

If the mating card is inserted in a wrong direction, namely with the shorter edge at top, this edge is collided with the surface of the protector 15 and is prevented further insertion in general.

Even the user would press in the card further, the top of numbers of the pin contacts 12 may support the edge to stop it. In such a case as a plural number of top of the contacts resist against the pressing force so that each contact head may not get detrimental damage.

FIG. 2 shows the connector 10 after the protector is assembled.

Figure 4:
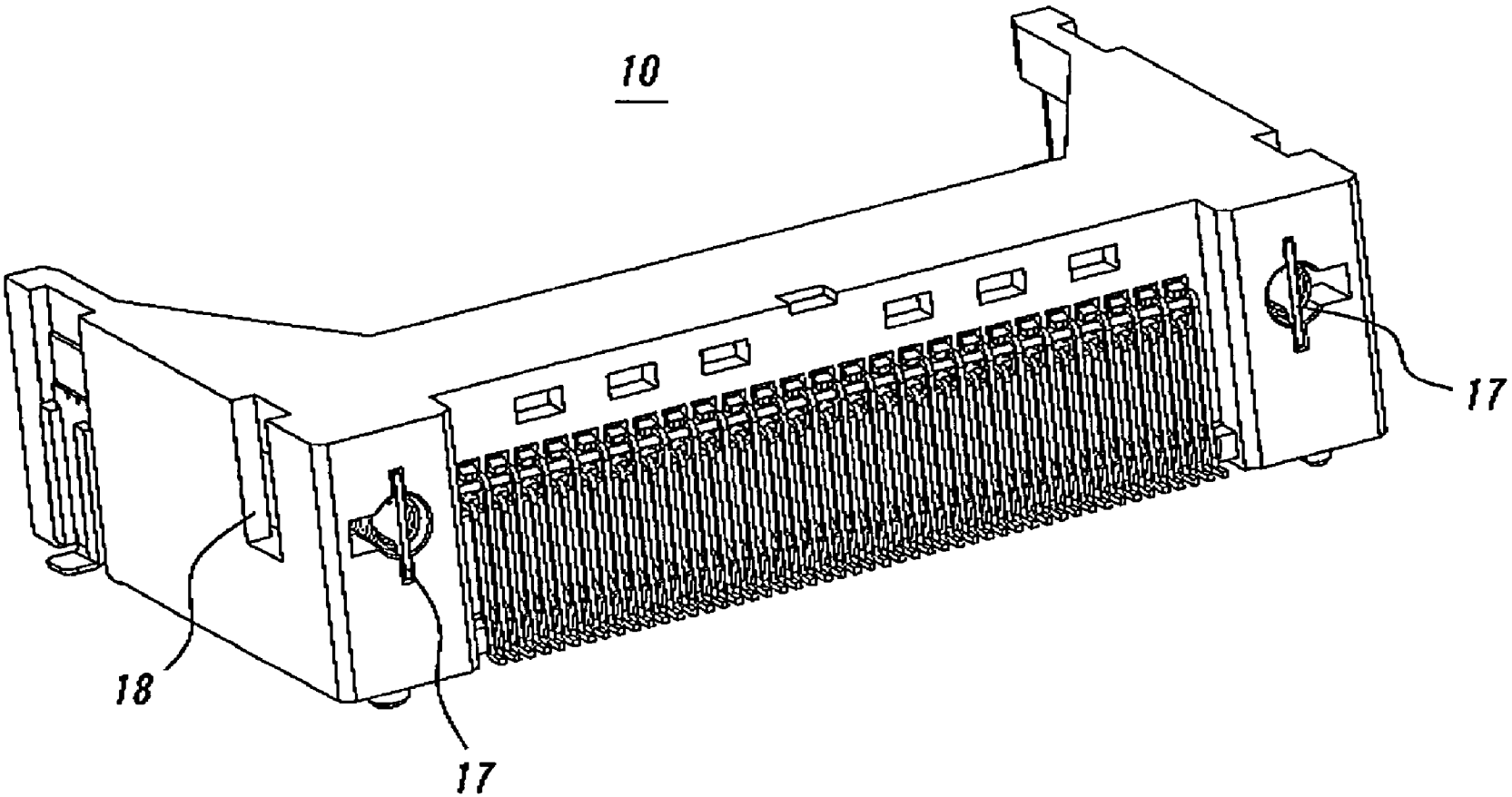
Figure 5:
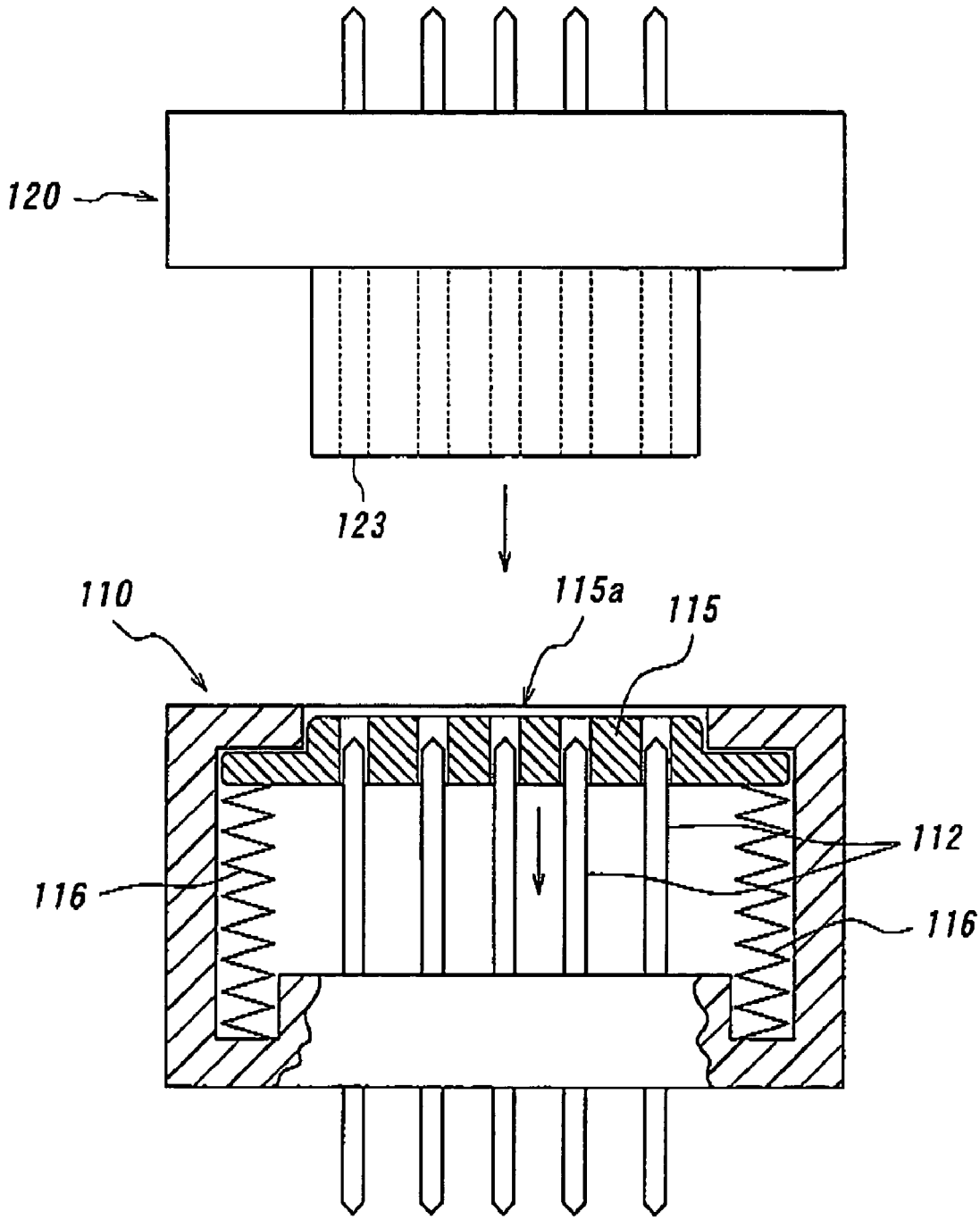
FIG. 5 PRIOR ART
FIG. 5 shows diagrammatical explanation view of a female connector and mating male connector having a protector plate of prior art.
Figure 6:
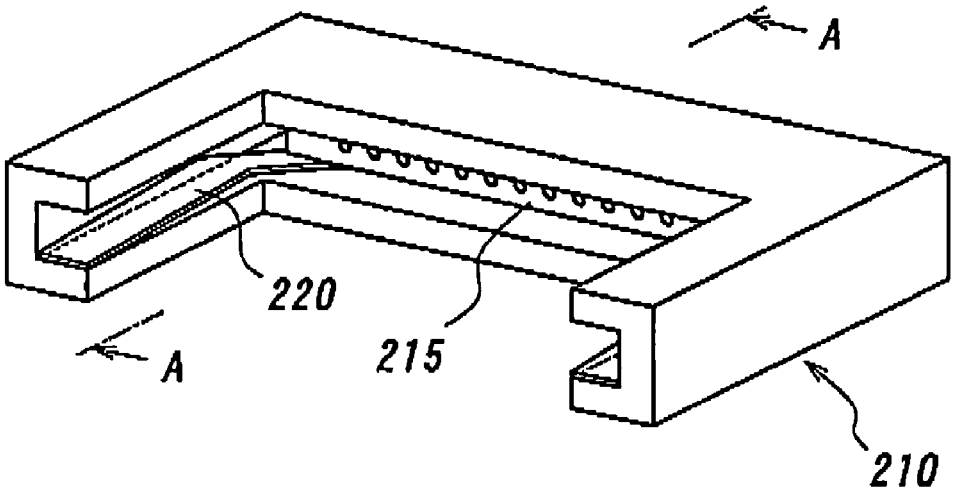
FIG. 6 PRIOR ART
FIGS. 6 and 7 show two views of a male connector to be mated with an information card and having a protector plate of prior art.
Figure 7:
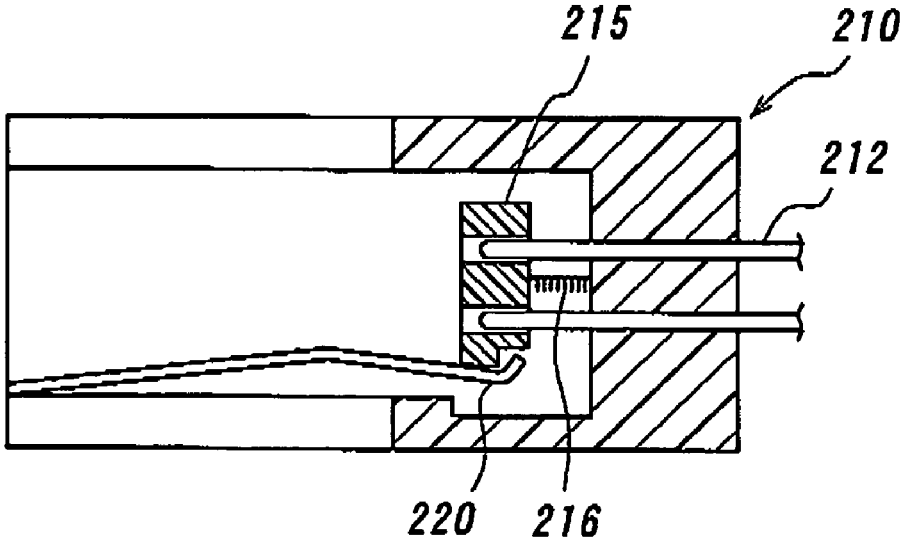
FIG. 7 PRIOR ART

FIGS. 3 and 4 show back side views of FIGS. 1 and 2 respectively.

As has been explained in the foregoing, the connector according to the invention has its merit without having troublesome assembling step to place the protector and associated bias springs and other parts from the open end of the connector.

In the present invention the protector is placed in positions from lateral or normal direction viewed from normal card insertion direction. The insertion or guide slot 18 and part to accept the inserted protector is provided by the initial molding of the connector body so that no additional cost is expected.

Although the invention was explained for male contact connector. The protector can be used by the same idea for a female connector with female contacts.

What is claimed is:

1. An electric connector having a plurality of contacts arranged in fine pitches and having a connector body made of plastics, and having a plate shaped protector to protect the top portion of the contacts, the protector is provided with through holes for the contacts to pass through and to protect the top portion of the contacts in their normal positions from outside forces, and the protector is pressed backwards when a mating connector or card is inserted in correct position to allow the connection of the contacts, wherein the connector body has an open hole at sides thereof to allow the insertion of the protector during assembly into the connector body in a direction normal to an insertion direction of the mating connector.

2. The electric connector as claimed in claim 1, wherein the contacts are male contacts.

3. The electric connector as claimed in claim 1, wherein the connector is to accommodate an information card or card type connector.

4. The electric connector as claimed in claim 1, wherein a bias force is applied to the protector using a bias spring to keep the protector in normal protecting position, and the bias spring is inserted from the rear side of the connector through an inserting hole.

5. The electric connector as claimed in claim 4, wherein the bias spring is kept in position by a fixing pin inserted from the rear side of the connector.

* * * * *